US008056983B2

(12) United States Patent
Adams et al.

(10) Patent No.: US 8,056,983 B2
(45) Date of Patent: Nov. 15, 2011

(54) LUMBAR SUPPORT AND HEAD REST ADJUSTMENT MECHANISM

(75) Inventors: Chad Edward Adams, Perrysburg, OH (US); Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 447 days.

(21) Appl. No.: 12/338,545

(22) Filed: Dec. 18, 2008

(65) Prior Publication Data

US 2010/0156159 A1 Jun. 24, 2010

(51) Int. Cl.
*A47C 7/36* (2006.01)

(52) U.S. Cl. ..... 297/408

(58) Field of Classification Search ..... 74/501.6; 297/408, 410, 284.4, 463.1
See application file for complete search history.

(56) References Cited

U.S. PATENT DOCUMENTS

| | | | | |
|---|---|---|---|---|
| 5,107,720 | A * | 4/1992 | Hatfield | 74/502 |
| 5,217,278 | A | 6/1993 | Harrison et al. | |
| 5,497,676 | A * | 3/1996 | Barnard | 74/501.5 R |
| 5,595,420 | A * | 1/1997 | Rogers | 297/85 C |
| 5,813,944 | A * | 9/1998 | Grindle | 477/209 |
| 5,842,738 | A | 12/1998 | Knoll et al. | |
| 6,789,847 | B1 * | 9/2004 | Tsai | 297/342 |
| 6,860,564 | B2 | 3/2005 | Reed et al. | |
| 7,131,694 | B1 | 11/2006 | Buffa | |
| 2004/0160108 | A1 | 8/2004 | Malsch et al. | |
| 2005/0156456 | A1 | 7/2005 | Robinson et al. | |
| 2006/0103215 | A1 | 5/2006 | Hoffmeister et al. | |
| 2009/0184555 | A1 * | 7/2009 | Yetukuri et al. | 297/408 |

OTHER PUBLICATIONS

International Search Report for International Application No. PCT/US2009/065242 mailed Jul. 2, 2010.

Written Opinion of the International Searching Authority for International Application No. PCT/US2009/065242 mailed Jul. 2, 2010.

* cited by examiner

*Primary Examiner* — Milton Nelson, Jr.

(74) *Attorney, Agent, or Firm* — Harness, Dickey & Pierce, P.L.C.

(57) ABSTRACT

A furniture member mechanism includes upper and lower housing structures, the lower housing structure including first and second side frames. A mechanism is disposed within both the upper and lower housing structures, including first and second lever arms having an upper end, a body extending into both the upper and lower housing structures, and a lower end positioned in the lower housing structure and rotatably connected to the first and second side frames. A bracket is connected to the first and second side frames. First and second biasing members are connected to the first and second lever arms and the bracket. The first or second biasing member extends when the first or second lever arm is rotated from an initial position in a lever forward direction. A biasing force of the first or second biasing member biases the first or second lever arm toward the initial position.

21 Claims, 15 Drawing Sheets

LUMBAR SUPPORT AND HEAD REST ADJUSTMENT MECHANISM

FIELD

The present disclosure relates to devices used to adjust furniture member components.

BACKGROUND

This section provides background information related to the present disclosure which is not necessarily prior art.

Conventionally, reclining articles of furniture (i.e., chairs, sofas, loveseats, and the like), referred to hereinafter generally as reclining chairs, utilize a mechanism to bias a leg rest assembly in extended and stowed positions and separate components to allow a back seat member to recline with respect to a seat base. Known furniture members can also include mechanism designs that also permit the reclining chair to rock in a front-to-back motion with respect to an occupant. Occupant lumbar support is commonly provided by one or more cushion members which abut with or are connected to a horizontally configured member such as a strap or similar flexible member. This member is commonly joined at its ends to vertically oriented backrest side support arms which are in turn rotatably connected to a furniture member chair frame.

Most reclining chairs upholster the chair frame and support the chair frame from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., stowed) and elevated (i.e., extended or protracted) positions.

Known leg rest assemblies and furniture member mechanisms are operated by a manually rotatable handle positioned on an outside surface of the furniture member. When rotated, the handle fully repositions the leg rest assembly from a stowed to a fully extended position, or is oppositely rotated to return the leg rest assembly to the stowed position. Known handle operated systems are generally not intended to provide position control of the lumbar support member or head rest member. Other known leg rest assemblies and furniture mechanisms are operated by a release device which is repositioned from a normally closed position to a release position, and biased to return to the normally closed position when released by the occupant. These devices also generally do not provide position control of lumbar support member or head rest member.

SUMMARY

This section provides a general summary of the disclosure, and is not a comprehensive disclosure of its full scope or all of its features. Co-pending disclosures Ser. No. 12/338,321 and Ser. No. 12/338,392 each filed on the same date as the present disclosure are commonly assigned to the assignee of the present disclosure. The entire disclosures of each of the above applications identified by Ser. No. 12/338,321 Ser. No. 12/338,392 are incorporated herein by reference.

According to several embodiments of the present disclosure, a furniture member adjustment system mechanism includes a mechanism disposed within both an upper housing structure, and a lower housing structure connected to the upper housing structure. The first mechanism includes a lever arm having an upper end extending above the upper housing structure, a body extending into both the upper and lower housing structures, and a lower end. A cable connection bracket is connected to the lower end of the lever arm. The cable connection bracket has a cable connection slot. A fastener rotatably connects the cable connection bracket and the lower end of the lever arm to the lower housing structure defining a common axis of rotation for the lever arm.

According to additional embodiments, a furniture member adjustment system mechanism includes an upper housing structure and a lower housing structure connected to the upper housing structure. The lower housing structure includes first and second side frames. A mechanism is disposed within both the upper and lower housing structures, including first and second lever arms each having an upper end extending above the upper housing structure, a body extending into both the upper and lower housing structures, and a lower end positioned in the lower housing structure and rotatably connected to the first and second side frames. A biasing member connection bracket is connected to the first and second side frames of the lower housing structure. First and second biasing members are each connected to one of the first and second lever arms and the biasing member connection bracket. The first and second biasing members are individually extended when one of the first or second lever arms is rotated from an initial position in a lever forward direction. A biasing force created by extension of the first or second biasing member operates to bias the first or second lever arm toward the initial position.

According to other embodiments, a furniture member adjustment system includes a mechanism disposed within both an upper housing structure and a lower housing structure connected to the upper housing structure. First and second lever arms each having an upper end extending above the upper housing structure, a body extending into both the upper and lower housing structures, and a lower end positioned in the lower housing structure. An adjustment slide connected to an upper end of each of the first and second lever arms to assist in manually rotating the first and second lever arms. First and second cable connection brackets are connected to the lower end of each of the first and second lever arms. Each of the first and second cable connection brackets have a cable connection slot. A fastener rotatably connects both the first and second cable connection brackets and the lower ends of the first and second lever arms to the lower housing structure. The fastener defines a common axis of rotation for the first and second lever arms. First and second cables are individually slidably disposed within first and second flexible cable sheaths. The first and second cables each have a first end individually engaged to the cable connection slot of one of the first and second cable connection brackets and a second end connected to a furniture member component operating when axially displaced to move the furniture member component.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
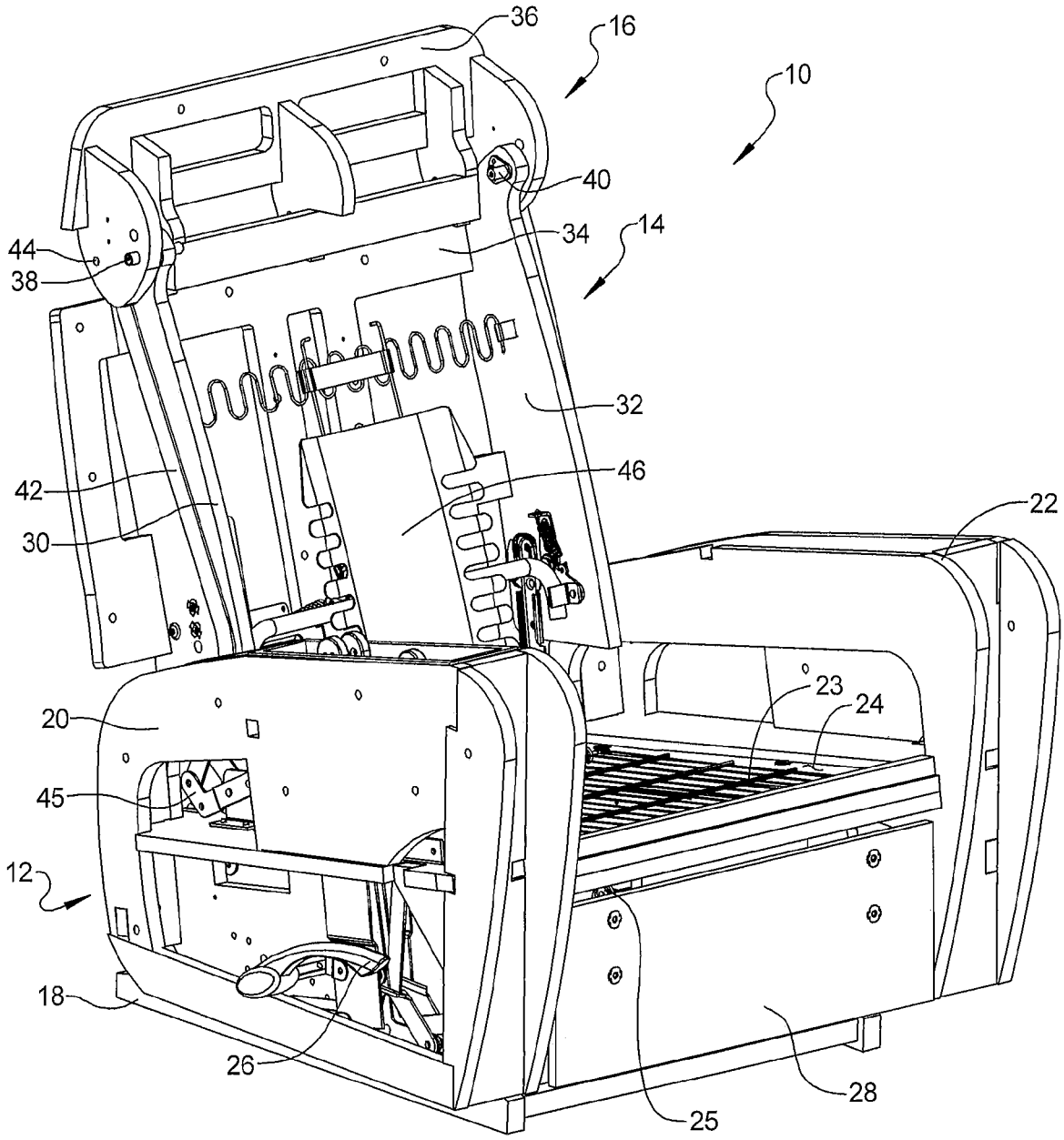
FIG. 1 is a right side perspective view of a furniture member having a lumbar support and headrest adjustment mechanism of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to FIG. 1, a furniture member 10 of the present disclosure is presented generally in the form of a rocking, reclining chair, however furniture member 10 can be any type of seating or occupant support member including a sofa, love-seat, sectional member, non-rocking reclining chair, or the like. Furniture member 10 includes a base portion 12 which rotatably supports a back support portion 14. A headrest portion 16 can be connected to back support portion 14. A base support section 18 can be positioned on a planar surface such as a floor. First and second armrest members 20, 22 are connected to base portion 12 and provide occupant arm support and additional features that will be further described herein.

A plurality of sinuous wire members 23 can be suspended over a cavity created within a frame pan 24 of base portion 12. Sinuous wire members 23 provide vertical support for the weight of an occupant of furniture member 10. According to several embodiments, sinuous wire members 23 are made of a spring steel material. When the weight of the occupant is supported by sinuous wire members 23, back support portion 14 provides a back or back rest support for an occupant of furniture member 10. A leg rest mechanism 25 is positioned below the frame pan 24. A leg rest extension device 26 such as a hand lever or switch is connected to leg rest mechanism 25 which can be used to extend or retract an occupant leg rest 28 (shown in a fully retracted position).

Back support portion 14 can be formed from wood members such as first and second side frame members 30, 32 which are connected to a rear frame member 34. A head rest frame 36 is movably connected to rear frame member 34. A support position of head rest frame 36 can be varied from the fully rearward rotated position shown in FIG. 1, to a forward rotated position and an upward extended position (shown in reference to FIGS. 3 and 4 herein) by an occupant of furniture member 10 at the discretion of the occupant. Head rest frame 36 can be movably connected to first and second side frame members 30, 32 using first and second head rest pins 38, 40. Head rest frame 36 is rotatable forward and rearward with respect to an occupant of furniture member 10 by displacement of an actuation link 42 which is rotatably connected at a first end to head rest frame 36 by a link pin 44, and at a second end to an actuation assembly 45.

A lumbar support system 46 can be movably connected to rear frame member 34. A support position of lumbar support system 46 can be varied from the fully retracted position shown in FIG. 1 forward toward the lumbar region of an occupant of furniture member 10 at the discretion of the occupant. The fully extended position of lumbar support system 46 is shown and described in reference to FIG. 14 herein.

Figure 2:
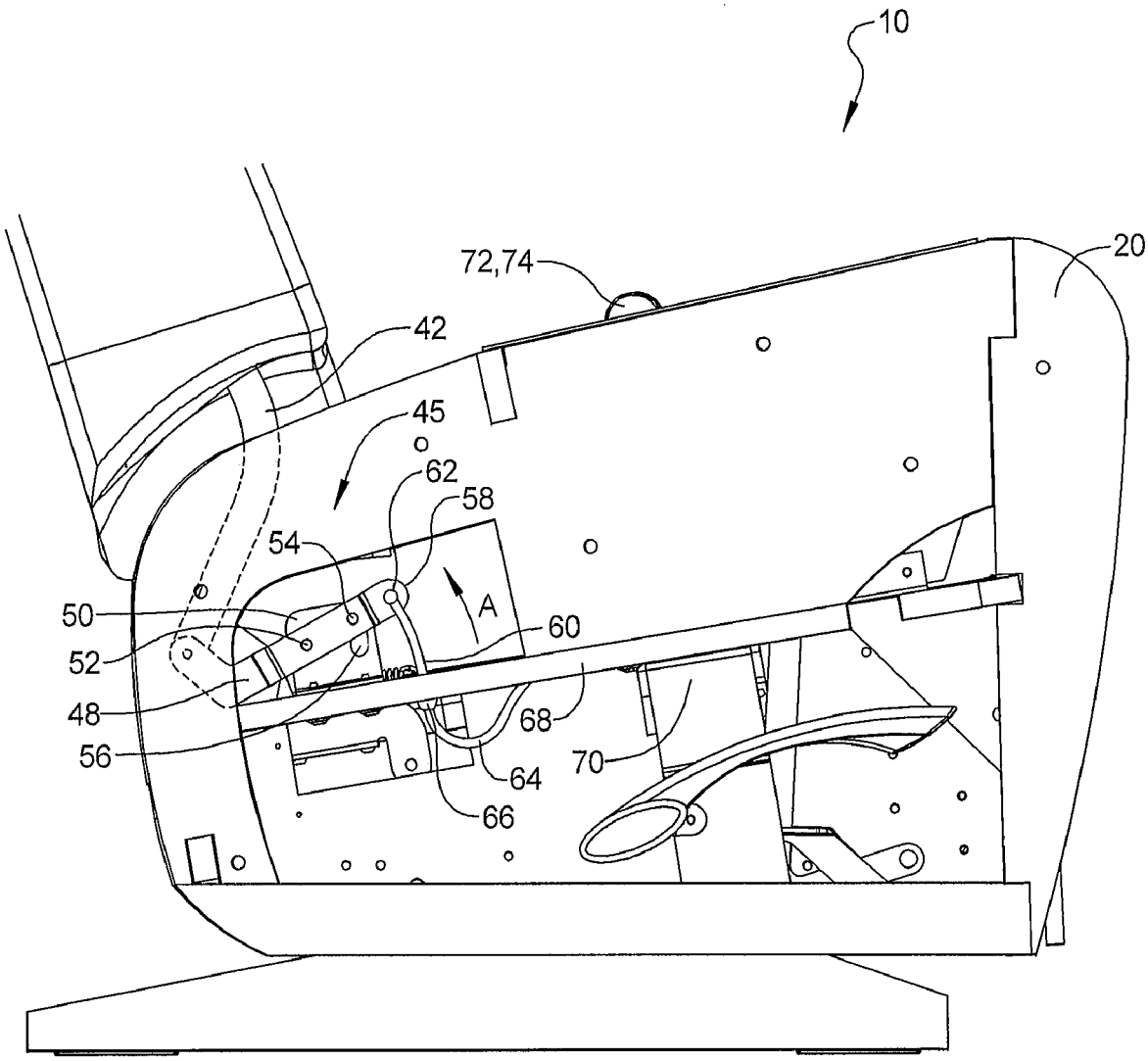
FIG. 2 is a side elevational view of the furniture member of FIG. 1.
Figure 10:
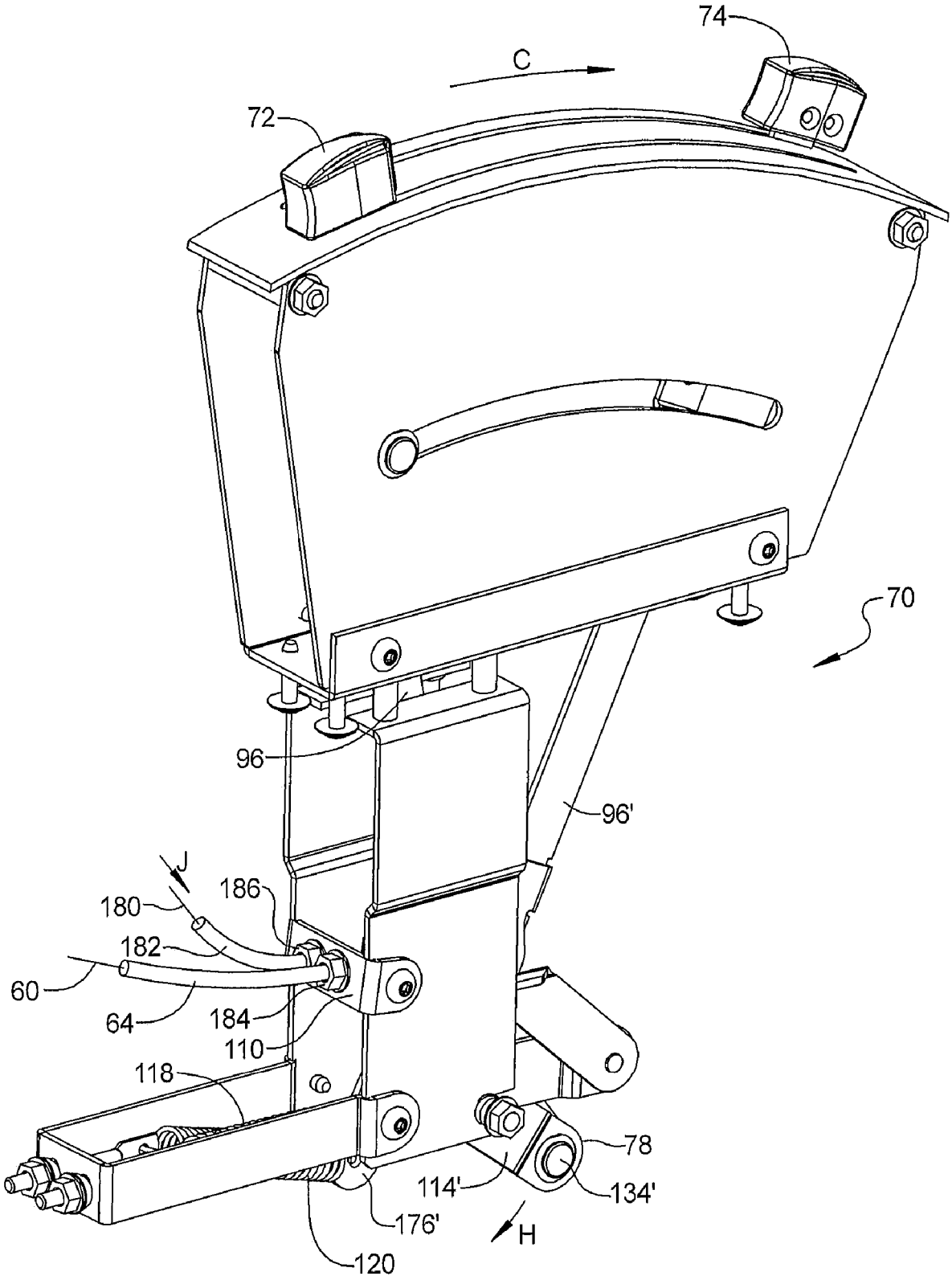
FIG. 10 is a side perspective view of the mechanism of FIG. 5 showing a first adjustment slide in a forward rotated position.

Referring to FIG. 2, actuation assembly 45 includes an actuation arm 48 which is rotatably connected to a bracket 50 using a rotational pin 52. An extending pin 54 extends transversely from actuation arm 48 and is slidably received within an arcuate slot 56 of bracket 50. Opposite ends of arcuate slot 56 provide rotational stops for extending pin 54 including an upper stop when actuation arm 48 is rotated in a headrest return actuation direction "A" to its furthest extent. A force receiving end 58 of actuation arm 48 receives a force causing rotation of actuation arm 48 from a cable 60. Cable 60 is attached to force receiving end 58 through a cable connection bore 62. Cable 60 is slidably disposed for most of its length in a cable sheath 64. A cable connector 66 which contacts an armrest frame member 68 fixes a first end of cable sheath 64. An opposite end of cable 60 and cable sheath 64 are connected to a first slide control mechanism 70 as will be further described in reference to FIG. 10 herein. First slide control mechanism 70 includes each of a headrest fore/aft adjustment slide 72 and a headrest vertical adjustment slide 74 which are each manually displaceable from the rearward position shown by an occupant of furniture member 10.

Figure 3:
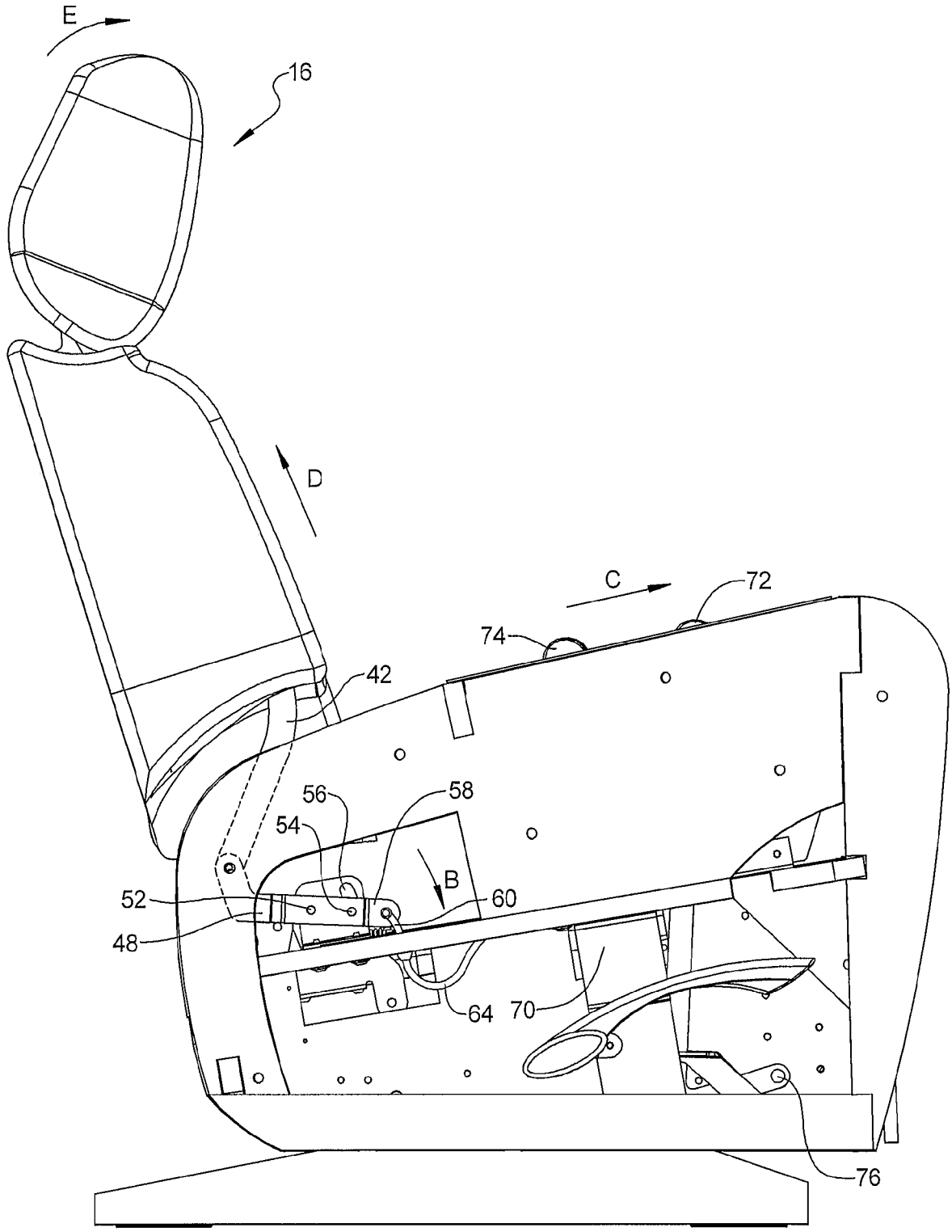
FIG. 3 is a side elevational view of the furniture member of FIG. 1 further showing a headrest forward rotated position.

Referring to FIG. 3, cable 60 has been withdrawn into cable sheath 64 which rotates force receiving end 58 in a headrest forward actuation direction "B" about rotational pin 52. Force receiving end 58 can rotate in the headrest forward actuation direction "B" until extending pin 54 contacts a lower end of arcuate slot 56. Cable 60 is retracted into cable sheath 64 by displacing headrest fore/aft adjustment slide 72 in a lever forward direction "C" to a furthest extent which rotates a first actuation member 76 of first slide control mechanism 70 as shown.

As actuation arm 48 rotates in the headrest forward actuation direction "B" actuation link 42 which is rotatably connected to actuation arm 48 is displaced in a link displacement direction "D". This displacement of actuation link 42 causes a forward rotation of headrest portion 16 in a headrest forward direction "E". Moving headrest fore/aft adjustment slide 72 in an opposite direction of lever forward direction "C" will rotate headrest portion 16 in an opposite direction to return headrest portion 16 to the orientation shown in FIG. 1.

Figure 4:
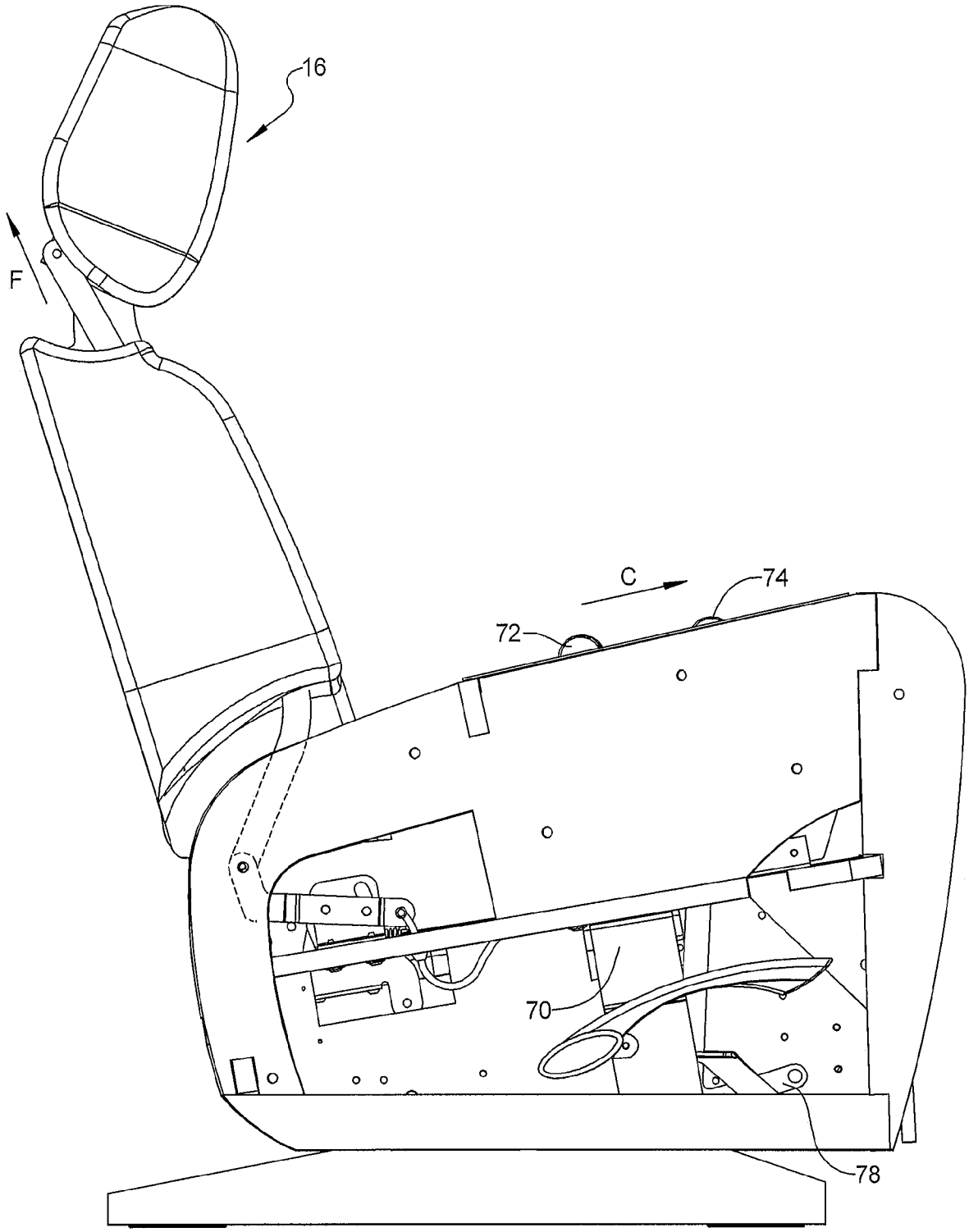
FIG. 4 is a side elevational view of the furniture member of FIG. 1 further showing a headrest extended position.

Referring to FIG. 4, by sliding headrest vertical adjustment slide 74 in the lever forward direction "C" a second actuation member 78 of first slide control mechanism 70 is rotated to the position shown which displaces headrest portion 16 in a headrest extension direction "F". An opposite motion of headrest vertical adjustment slide 74 will return headrest portion 16 to the non-extended position in a direction opposite to headrest extension direction "F".

Figure 5:
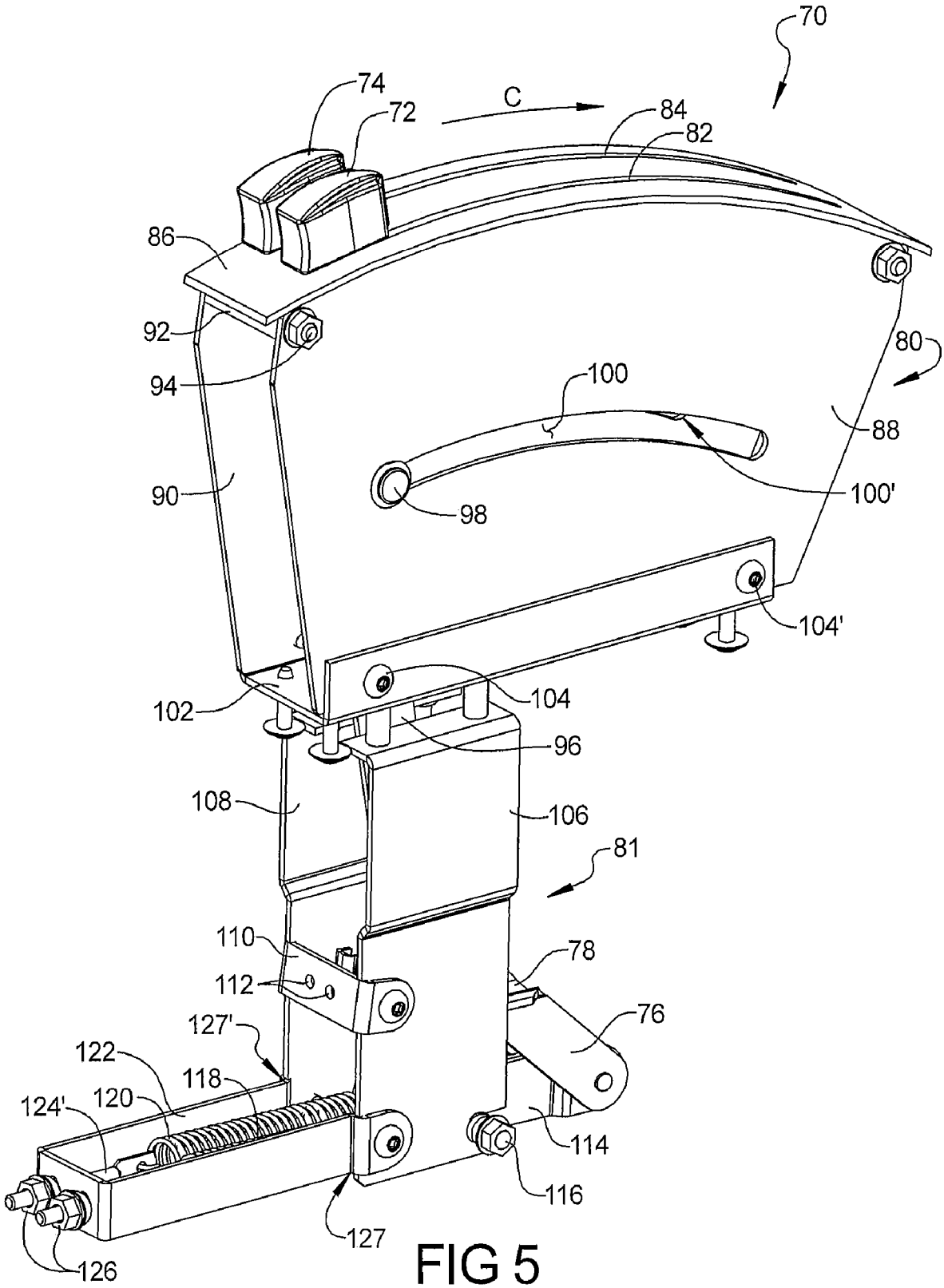
FIG. 5 is a side perspective view of a lumbar support and headrest adjustment mechanism of the present disclosure.

Referring to FIG. 5, the features of first slide control mechanism 70 include an upper housing structure 80 which is fastenably connected to a lower housing structure 81. Upper housing structure 80 includes a first and second slide tracking slot 82, 84 which guide the displacement of headrest fore/aft adjustment slide 72 and headrest vertical adjustment slide 74 for motion in the lever forward direction "C" and the reverse direction. First and second slide tracking slots 82, 84 are created in an upper housing cover 86 which is fastenably connected to each of a first side panel 88 and a substantially parallel second side panel 90. A fastener receiving tube 92 can be homogenously extended in two locations of upper housing cover 86 to slidably receive a fastener 94 in each fastener receiving tube 92 to fastenably engage upper housing cover 86 to each of first and second side panels 88, 90. First and second lever arms 96, 96' (only first lever arm 96 is clearly visible in this view) extend through each of upper housing structure 80 and lower housing structure 81 and are individually connected to one of the headrest fore/aft adjustment slide 72 and the headrest vertical adjustment slide 74. To help guide each of the first and second lever arms 96, 96' a slide rivet 98, 98' (slide rivet 98' is not clearly visible in this view) is connected to each of the lever arms 96, 96' and each is slidably received within an arcuate rivet receiving slot 100, 100' created in each of the first and second side panels 88, 90. A housing base 102 which in several embodiments is a plate bent or constructed to form a substantially U-shape is fastened using fasteners 104, 104' to each of first and second side panels 88, 90.

Lower housing structure 81 includes each of a first and second side frame 106, 108 which can be substantially mirror images of each other. A cable sheath connection bracket 110 is fixed or fastenably connected to both first and second side frames 106, 108. Cable alignment apertures 112 are created in cable sheath connection bracket 110 to allow for sliding motion of cables such as cable 60 described in reference to FIG. 2 and as will be further described herein. A first actuation arm 114 is rotatably connected to first actuation member 76 and a second actuation arm 114' (not clearly visible in this view) is connected to second actuation member 78. A tension adjustment fastener 116 is provided to control the amount of friction created to resist rotation of first and second actuation members 76, 78 and first and second actuation arms 114, 114' by tightening or loosening tension adjustment fastener 116.

First and second extension springs 118, 120 can be oriented substantially parallel to each other within a spring connection bracket 122. According to several embodiments, spring connection bracket 122, and first and second extension springs 118, 120 are co-linearly aligned with first and second actuation arms 114, 114' when adjustment slides 72, 74 are positioned in a initial operating position as shown in FIG. 5. First and second extension springs 118, 120 bias the first and second actuation members 76, 78 and the lever arms 96, 96' to help retain headrest fore/aft adjustment slide 72 and headrest vertical adjustment slide 74 in the rearward positions shown in FIG. 5. A tension force in each of the first and second extension springs 118, 120 can be predetermined or modified by displacing spring connectors 124, 124' (only spring connector 124' is visible in this view) by rotation of spring tension adjustment fasteners 126. Bracket bends 127, 127' align with and contact edge faces of both first and second side frames 106, 108 to resist rotation of spring connection bracket 122.

Figure 6:
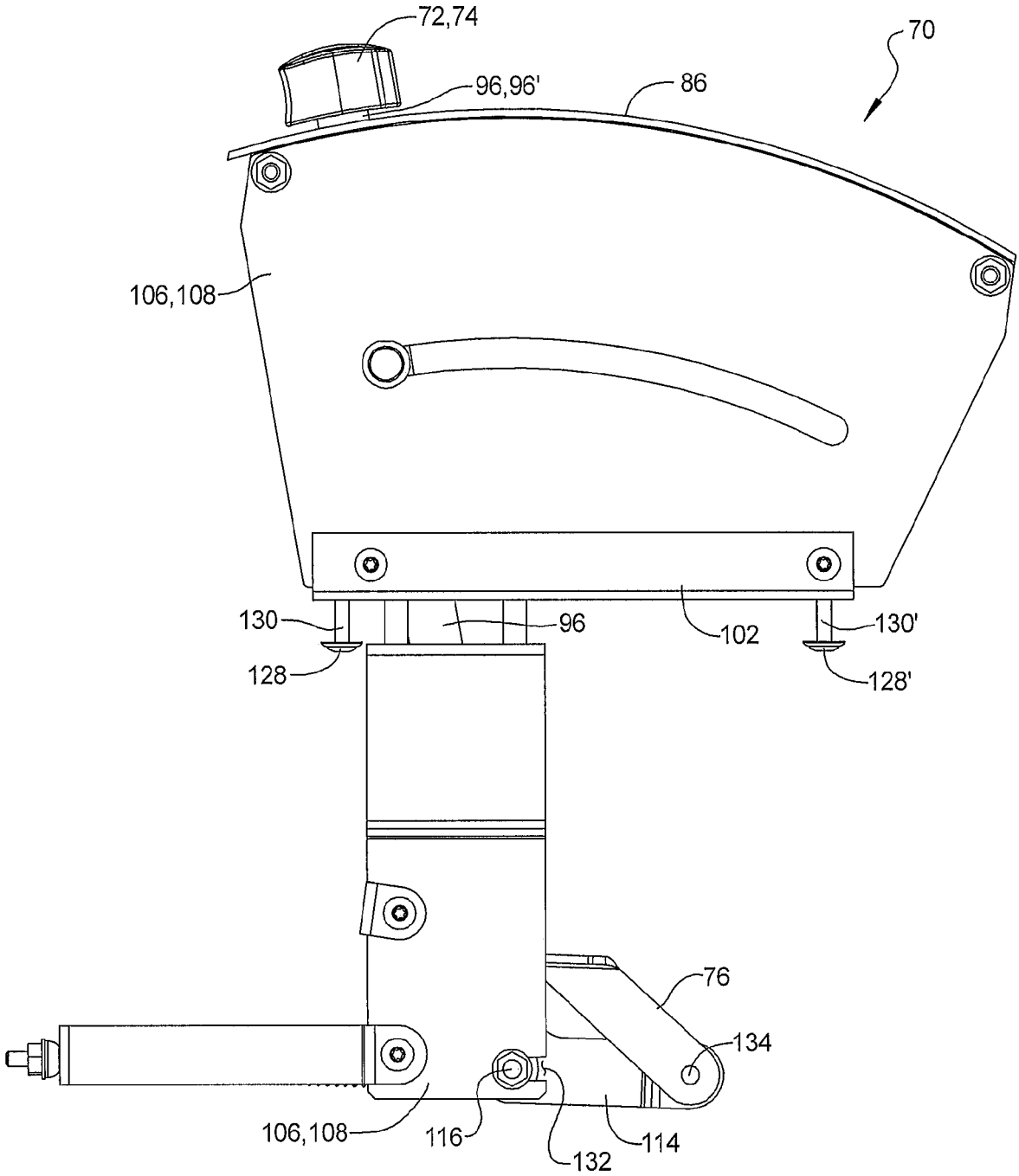
FIG. 6 is a side elevational view of the mechanism of FIG. 5.

Referring to FIG. 6, a plurality of housing mount fasteners 128, 128' are provided to allow fastening of first slide control mechanism 70 to furniture member 10. Housing mount fasteners 128, 128' are each received within corresponding fastener extension tubes 130, 130' to adjust the connection of housing mount fasteners 128, 128' to structure of furniture member 10. Fastener extension tubes 130, 130' are connected to a lower surface of housing base 102. A portion of each of the lever arms 96, 96' (only lever arm 96 is clearly shown in this view) extend above upper housing cover 86 so that adjustment slides 72, 74 have clearance for sliding motion with respect to upper housing cover 86. Tension adjustment fastener 116 is positioned or removed with respect to a fastener receiving slot 132 created in each of first and second side frames 106, 108 which allow installation or removal of first and second actuation members 76, 78 as well as first and second actuation arms 114, 114' as a sub-assembly. A rotational connection fastener 134 is used to rotatably connect first actuation member 76 to first actuation arm 114 and similarly to rotatably connect second actuation member 78 to second actuation arm 114'.

Figure 7:
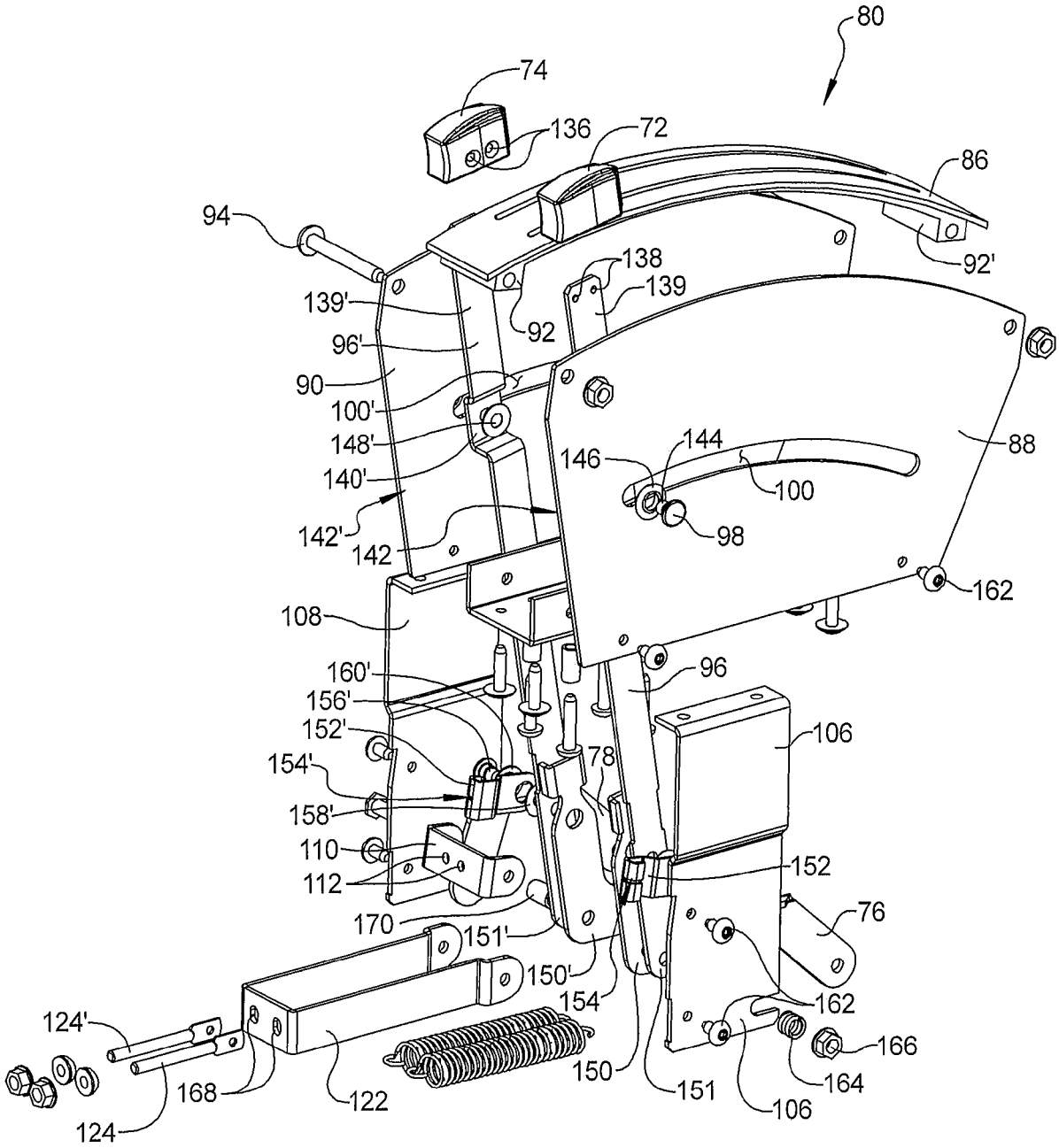
FIG. 7 is an exploded assembly perspective view of the mechanism of FIG. 5.

Referring to FIG. 7, each of the molded, polymeric adjustment slides 72, 74 include at least one and according to several embodiments two engagement bosses 136 which can be created at the time of molding adjustment slides 72, 74. Engagement bosses 136 are snap-received into a plurality of engagement recesses 138 created at upper ends 139, 139' of the lever arms 96, 96' that extend above upper housing cover 86. Each of the lever arms 96, 96' includes an arm offset portion 140, 140' (only arm offset portion 140' is clearly visible in this view) which provide a sliding contact between the arm offset portions 140, 140' and an inner face, 142, 142' respectively of first and second side panels 88, 90. A rivet tube 144 extending from each slide rivet 98 is slidably received in a rivet washer 146 before insertion of rivet tube 144 through each of the arcuate rivet receiving slots 100, 100'. A rivet retention connector 148, 148' is engaged as shown to an opposite side of lever arms 96, 96' at the arm offset portions 140, 140'. Contact between rivet tube 144 and opposite ends of the arcuate rivet receiving slots 100, 100' establishes maximum points of rotation for each of the lever arms 96, 96'.

First and second arm extenders 150, 150' are fastenably connected to lower ends 151, 151' of the lever arms 96, 96'. Cable connection brackets 152, 152' each including a cable connection slot 154, 154' are fastenably connected together with both lever arms 96, 96' and arm extenders 150, 150' using fasteners such as spin fasteners 156, 156' spin fastener nuts 158, 158', and washers 160, 160'. Connection fasteners 162 such as screws or rivets are used for example to connect cable sheath connection bracket 110 to each of first and second side frames 106, 108 as well as to connect the cable connection brackets 152, 152'.

A tension control spring 164 is held in position by a nut 166 to control the preload provided by tension adjustment fastener 116 (shown and described in reference to FIG. 5). Shaft receiving bores 168 are provided in a joining section of spring connection bracket 122 to slidably receive the shaft portions of spring connectors 124, 124'.

Figure 8:
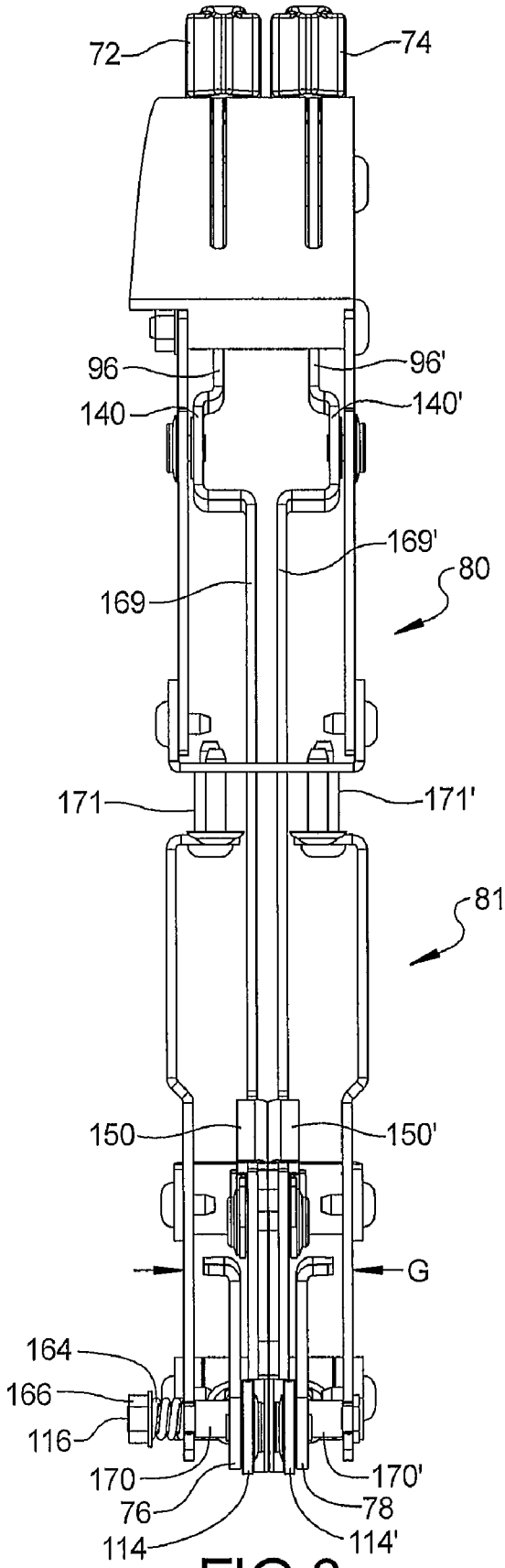
FIG. 8 is a front elevational view of the mechanism of FIG. 5.

Referring to FIG. 8, a body 169, 169' of first and second lever arms 96, 96' extends through both upper and lower housing structures 80, 81. A total assembly width "G" is defined by the combination of first and second actuation members 76, 78, first and second actuation arms 114, 114', and each of a first and second spacer to 170, 170'. Adjusting the preload force of tension control spring 164 using tension adjustment fastener 116 does not significantly alter assembly width "G", however increasing the preload of tension control spring 164 increases rotational friction and therefore inhibits rotation of first and second actuation members 76, 78 to a degree desired by the manufacturer. The relationship of arm offset portions 140, 140' of lever arms 96, 96' respectively is clearly evident from FIG. 8. Arm offset portions 140, 140' allow for displacement of adjustment slides 72, 74 while still maintaining interior clearance for lever arms 96, 96' as they move past tubular fastener spacers 171, 171' used to fastenably connect upper housing structure 80 to lower housing structure 81.

Figure 9:
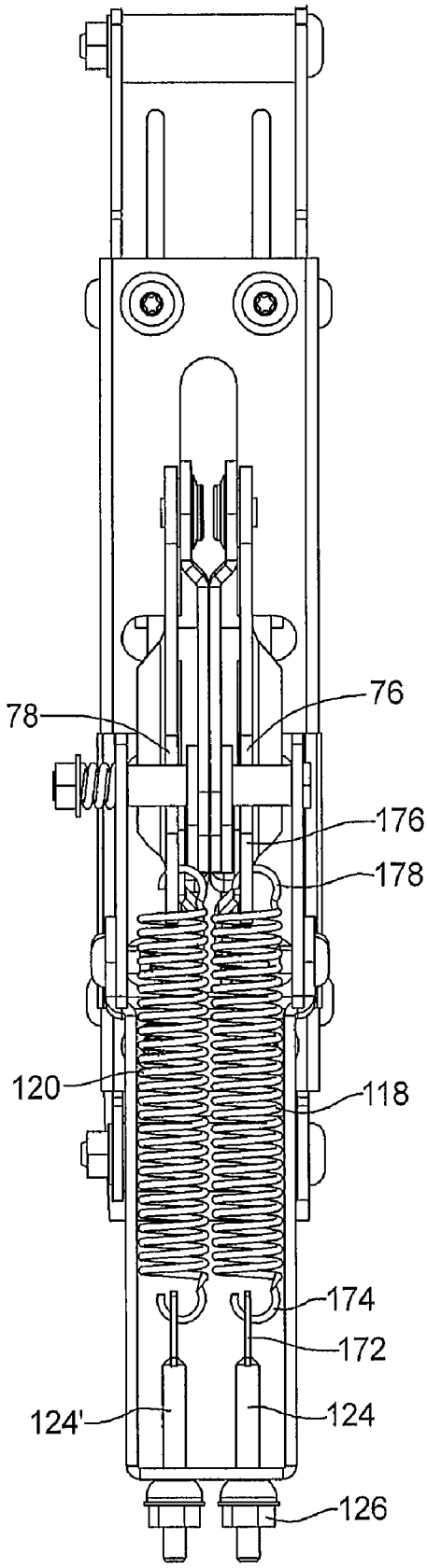
FIG. 9 is a bottom plan view of the mechanism of FIG. 5.

Referring to FIG. 9, installation of the first and second extension springs 118, 120 are similar to each other, therefore the following discussion of the installation of first extension spring 118 applies equally to the installation of second extension spring 120. A spade end 172 of spring connector 124 receives a first spring connecting end 174, and a spring connection actuation portion 176 of first actuation member 76 receives a second spring connecting end 178. Tightening or loosening spring tension adjustment fastener 126 therefore axially displaces spring connector 124 and spade end 172 to increase or decrease the preload force of first extension spring 118.

Referring to FIG. 10 and again to FIG. 7, cable 60 is slidably disposed within cable sheath 64 and a free end of cable 60 is engaged in cable connection slot 154 of cable connection bracket 152. Cable sheath 64 is fixedly connected to cable sheath connection bracket 110 using a first cable sheath connector 184. First cable sheath connector 184 therefore prevents axial displacement of cable sheath 64 when cable 60 is slidably displaced within cable sheath 64. Similarly, a second cable 180 is slidably disposed within a second cable sheath 182 and second cable sheath 182 is fastenably connected to cable sheath connection bracket 110 using a second cable sheath connector 186. In the example shown in FIG. 10, displacement of headrest vertical adjustment slide 74 in the lever forward direction "C" rotates lever arm 96' to the right as viewed in FIG. 10 which co-rotates second actuation member 78 and second actuation arm 114'. Cable connection bracket 152' is also displaced as lever arm 96' rotates, which pulls second cable 180 in a cable displacement direction "J". This displacement of second cable 180 acts to upwardly displace headrest portion 16 as shown in reference to FIG. 4. A similar movement of headrest fore/aft adjustment slide 72 in the lever forward direction "C" displaces cable 60 within cable sheath 64 in a similar manner, thereby rotating headrest portion 16 in the headrest forward actuation direction "E" shown in reference to FIG. 3. Second actuation member 78 and second actuation arm 114' both rotate in an actuation member rotation direction "H" when lever arm 96' rotates as shown. This rotation further displaces spring connection actuation portion 176' downwardly as shown which expands second extension spring 120, increasing the spring bias force of second extension spring 120. First extension spring 118 is not displaced by this motion.

Figure 11:
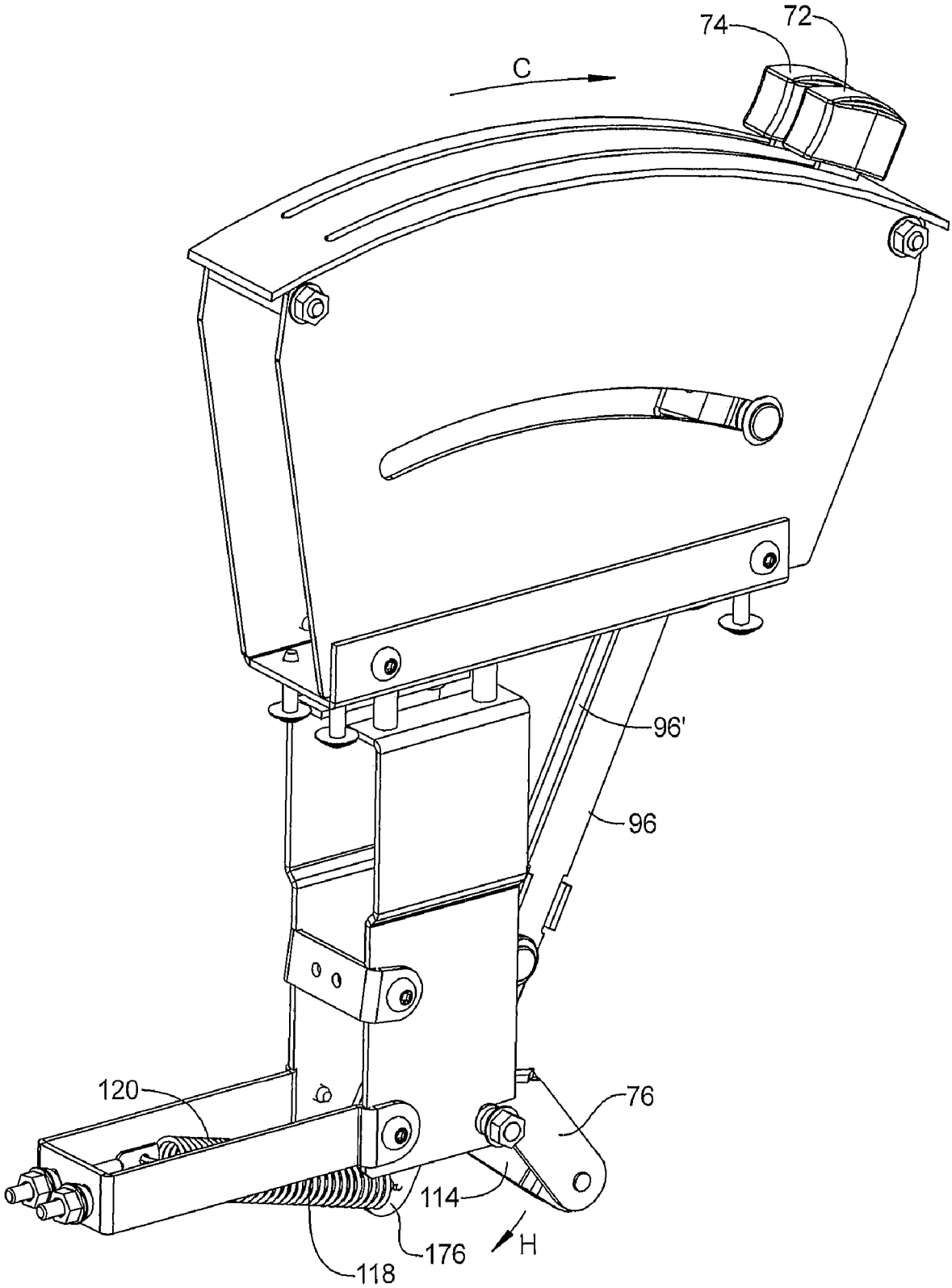
FIG. 11 is the side perspective view of the mechanism of FIG. 10 showing both first and second adjustment slides in a forward rotated position.

Referring to FIG. 11, when both lever arms 96, 96' are rotated in the lever forward direction "C" first actuation member 76 and first actuation arm 114 are also rotated in the actuation member rotation direction "H". This rotation displaces spring actuation portion 176 which extends first extension spring 118 increasing the spring bias force of first extension spring 118.

Figure 12:
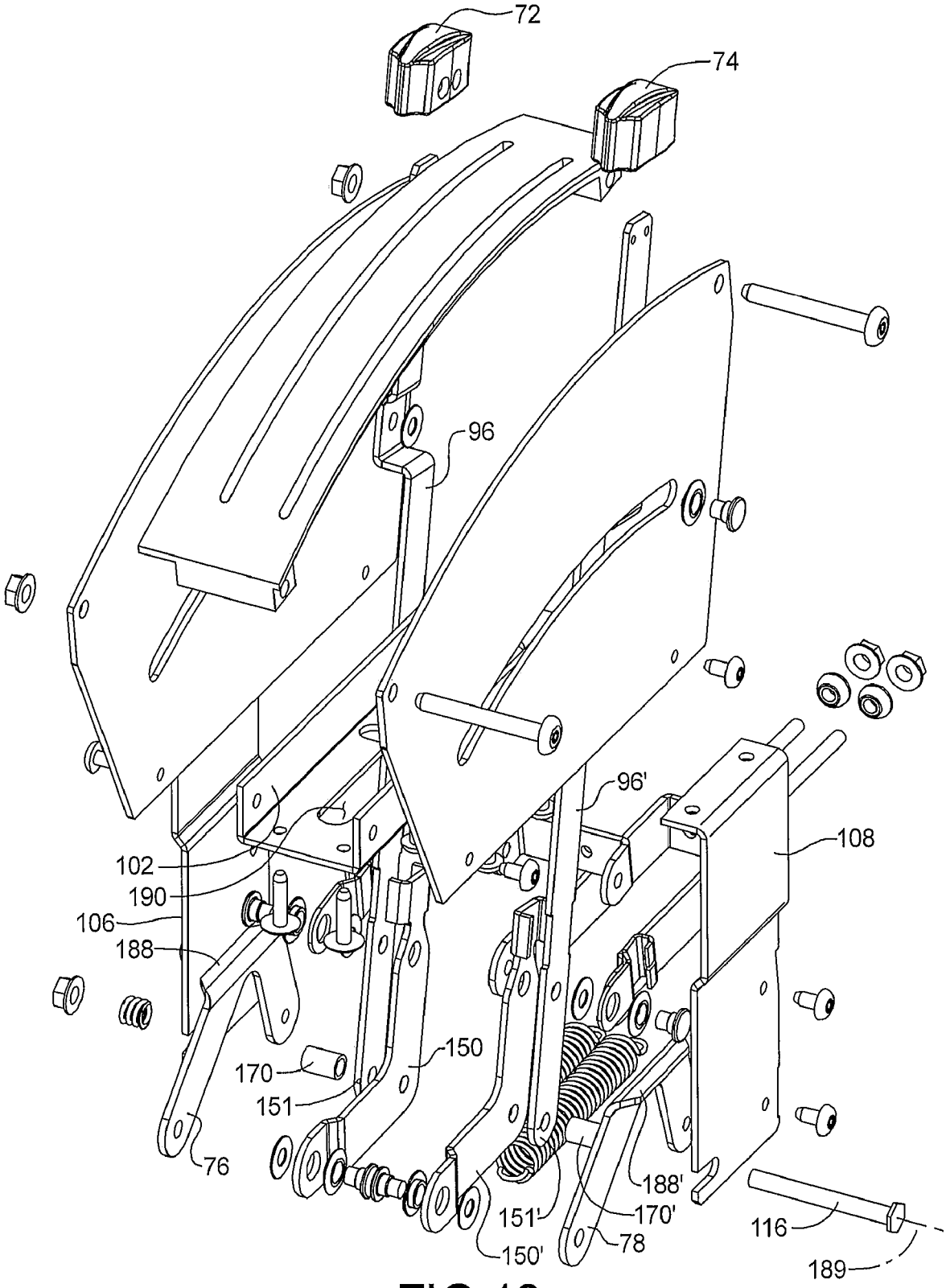
FIG. 12 is an exploded assembly rear perspective view of the mechanism of FIG. 5.

Referring to FIG. 12, each of the first and second actuation members 76, 78 define a "V" shape and include a reinforcement portion 188, 188' to provide rigidity. An arm receiving slot 190 is created in a base portion of housing base 102 to allow for the displacement of lever arms 96, 96'. According to several embodiments, arm receiving slot 190 is sufficiently long to prevent contact of either lever arm 96 or lever arm 96' with either end of arm receiving slot 190 as adjustment slides 72, 74 are moved throughout their displacement paths. Tension adjustment fastener 116 commonly extends through each of the first and second actuation members 76, 78, the arm extenders 150, 150', the lower ends 151, 151' of lever arms 96, 96', the spacer tubes 170, 170', and each of the first and second side frames 106, 108. Tension adjustment fastener 116 defines a common axis of rotation 189 for first and second lever arms 96, 96'.

Figure 13:
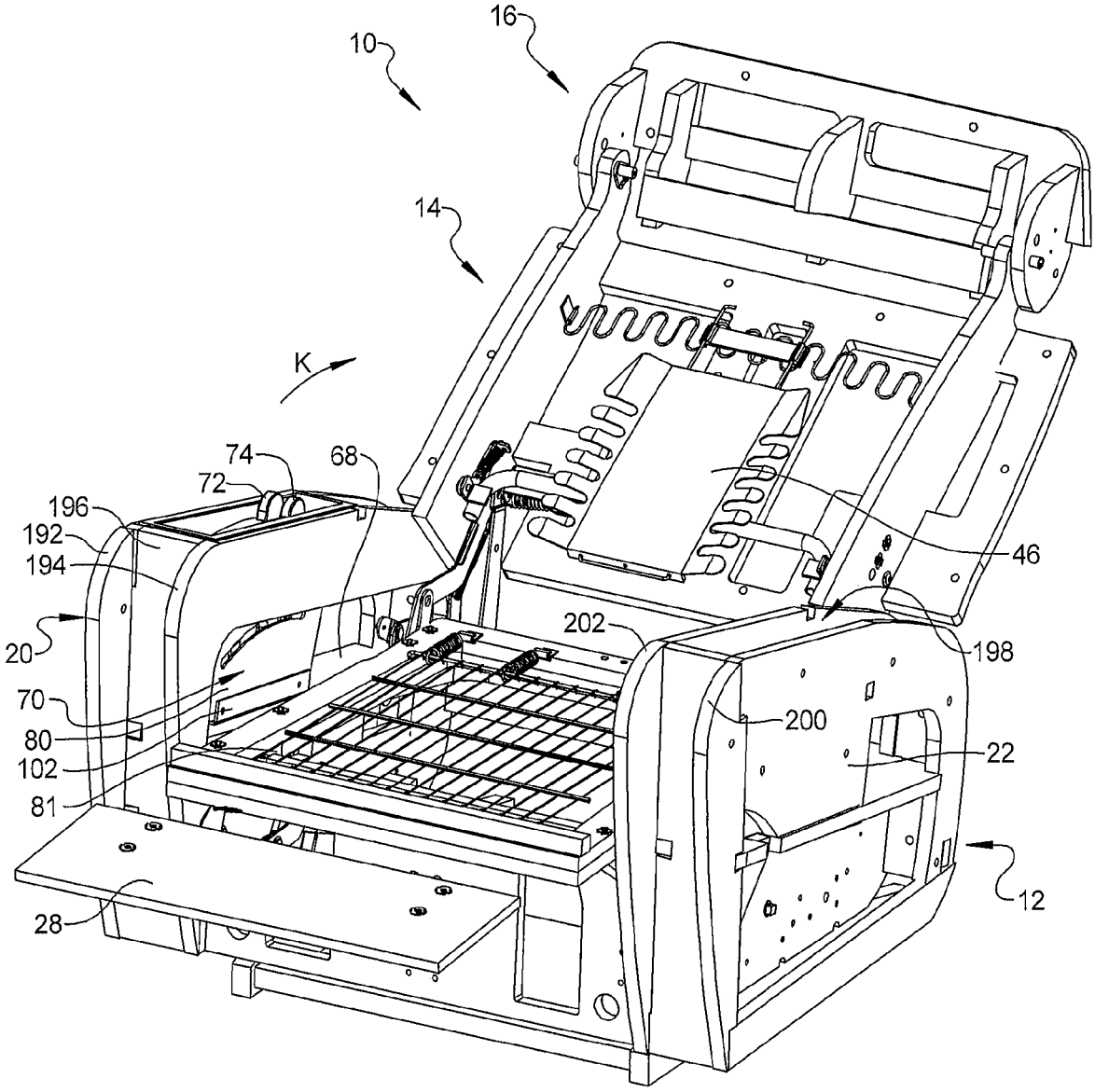
FIG. 13 is a left front perspective view of the furniture member of FIG. 1 showing a fully reclined and leg rest extended position.

Referring to FIG. 13, furniture member 10 is shown having the back support portion 14 fully rotated to a reclined position and leg rest 28 is shown in a fully extended position. Back support portion 14 is rotated with respect to base portion 12 in a reclining direction "K". First slide control mechanism 70 is positioned in a cavity defined between an exterior armrest frame element 192 and an interior armrest frame element 194 of first armrest member 20. Spacing between exterior and interior armrest frame elements 192, 194 is provided by a frame spacer 196. First slide control mechanism 70 is releasably fastened or fixed to armrest frame member 68 such that housing base 102 is in contact with an upper surface of armrest frame member 68 such that upper housing structure 80 is positioned above armrest frame member 68 and lower housing structure 81 is positioned below armrest frame member 68. According to several embodiments, first slide control mechanism 70 provides adjustment slides 72, 74 which act to adjust the position of headrest portion 16. A cavity 198 created between an exterior and an interior armrest frame element 200, 202 of second armrest member 22 can also be used for positioning first slide control mechanism 70 or an additional mechanism similar to first slide control mechanism 70 used to displace lumbar support system 46. It is noted that the relative position of either back support portion 14 or leg rest 28 do not change the position of either headrest fore/aft adjustment slide 72 or headrest vertical adjustment slide 74.

Figure 14:
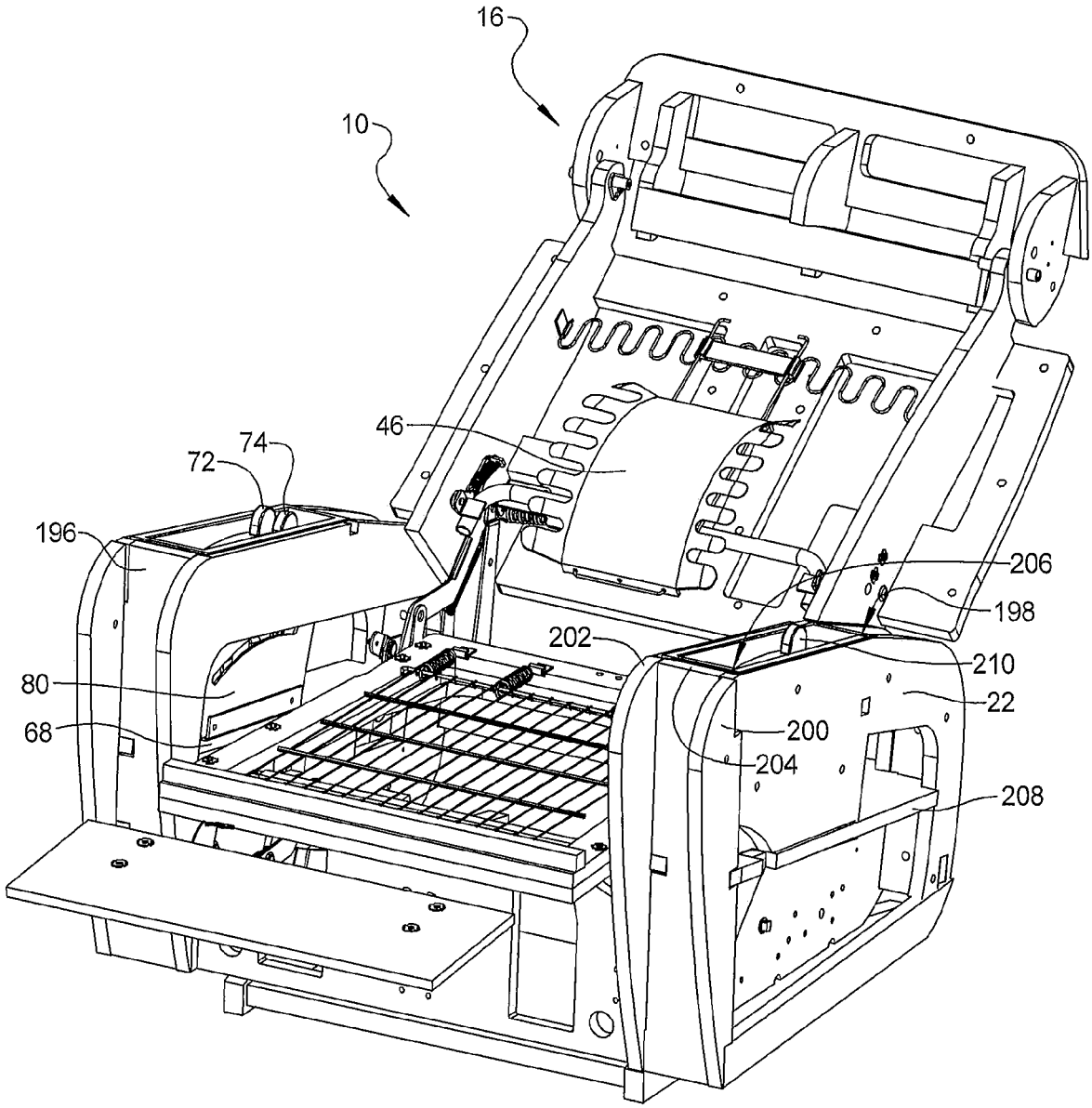
FIG. 14 is the left front perspective view of FIG. 13 further showing the lumbar support system in a fully extended position.

Referring to FIG. 14, a frame spacer 204 similar in function to frame spacer 196 is positioned between exterior and interior armrest frame elements 202 to create cavity 198 to receive a second slide control mechanism 206. Similar to first slide control mechanism 70, second slide control mechanism 206 is fastenably mounted to an armrest frame member 208 of second armrest member 22. At least one slide such as a lumbar adjustment slide 210 is provided by second slide control mechanism 206. Lumbar adjustment slide 210 operates similar to adjustment slides 72, 74 to control the support position of lumbar support system 46 between a fully retracted position as shown in reference to FIG. 13 and a fully extended position shown in FIG. 14.

Figure 15:
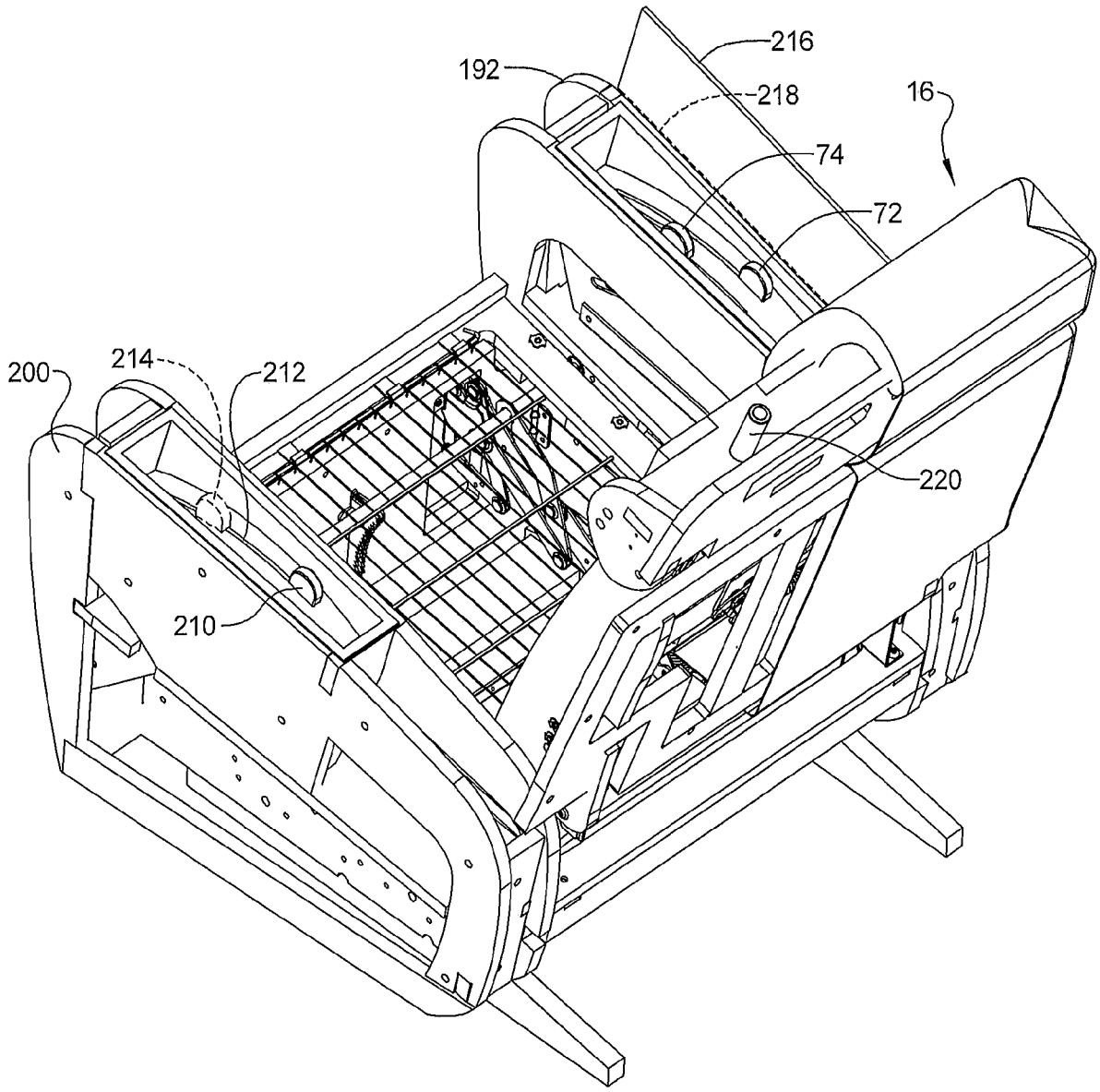
FIG. 15 is a rear left perspective view of the furniture member of FIG. 1.

Referring to FIG. 15, lumbar adjustment slide 210 can be moved within a slide tracking slot 212 to a lumbar maximum extension slide position 214 (shown in phantom) to provide the fully extended position of lumbar support system 46 shown in reference to FIG. 14. An upholstered cover 216 can be rotatably connected for example using a hinge 218 to exterior armrest frame element 192. Upholstered cover 216 is shown in an open position, and can be rotated closed to cover adjustment slides 72, 74. A similar upholstered cover (not shown for clarity) can be rotatably connected to exterior armrest frame element 200.

Referring again to FIGS. 15, 4, and 10, a cable connection device 220 is connected to the headrest portion 16. The second end of the second cable 180 is connected to cable connection device 220. Moving headrest vertical adjustment slide 74 and therefore second lever arm 96' in the lever forward direction "C" extends the headrest portion 16 in the headrest extension direction "E".

The lumbar support and headrest adjustment mechanisms of the present disclosure offer several advantages. By incorporating controls for manual operation of the headrest and lumbar support systems within cavities of the armrest of the furniture member, a forward and rearward motion of the slides is readily accomplished by an occupant of the furniture member. By using biasing springs to assist with the extension motion of the various adjustable members the force required by the occupant is reduced. Also by positioning the mechanisms in the armrest members a larger vertical displacement of the actuation arms is possible which also improves the force applied by the furniture member occupant. The use of cable and cable sheaths for connecting the mechanisms to the adjustable headrest and the lumbar support assembly reduced the complexity of positioning these cable sheaths inside the upholstery of the furniture member.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A furniture member adjustment system mechanism, comprising:

a mechanism disposed within both an upper housing structure and a lower housing structure connected to the upper housing structure, the upper housing structure having first and second side panels each having an arcuate-shaped slot, the mechanism including:

a lever arm having an upper end extending above the upper housing structure, a body extending into both the upper and lower housing structures, and a lower end;

a cable connection bracket connected to the lower end of the lever arm, the cable connection bracket having a cable connection slot;

a fastener rotatably connecting the cable connection bracket and the lower end of the lever arm to the lower housing structure defining a common axis of rotation for the lever arm; and a slide pin connected to the lever arm and slidably received in the arcuate-shaped slot of one of the first and second side panels, the slide pin contacting opposed ends of the arcuate-shaped slot to limit rotation of the lever arm.

2. The furniture member adjustment system mechanism of claim 1, further including:

first and second side frames of the lower housing structure;

an actuation arm rotatably connected to the fastener and rotatably connected to an actuation member;

a biasing member connection bracket connected to the first and second side frames of the lower housing structure; and a biasing member connected to the actuation member and the biasing member connection bracket;

wherein rotation of the lever arm in a first direction rotates the actuation arm and thereby rotates the actuation member and expands the biasing member to create a biasing force of the biasing member, the biasing force acting to return the lever arm in an opposite second direction.

3. The furniture member adjustment system mechanism of claim 1, further including a cable slidably disposed within a flexible cable sheath, the cable engaged at a first end to the cable connection slot of the cable connection bracket, the cable having a second end connected to and operating to move a furniture member component when the lever arm is rotated with respect to the common axis of rotation.

4. The furniture member adjustment system mechanism of claim 3, further including:

first and second side frames of the lower housing structure; and a cable sheath connection bracket connected to the first and second side frames, the cable sheath connection bracket including a cable alignment aperture adapted to slidably align the cable for engagement with the cable connection slot.

5. A furniture member adjustment system mechanism, comprising:

a mechanism disposed within both an upper housing structure and a lower housing structure connected to the upper housing structure, the mechanism including:

a lever arm having an upper end extending above the upper housing structure, a body extending into both the upper and lower housing structures, and a lower end;

a cable connection bracket connected to the lower end of the lever arm, the cable connection bracket having a cable connection slot;

a fastener rotatably connecting the cable connection bracket and the lower end of the lever arm to the lower housing structure defining a common axis of rotation for the lever arm;

an engagement recess created at the upper end of the lever arm; and an adjustment slide connected to an upper end of the lever arm, the adjustment slide including an engagement boss adapted to engage with the engagement recess to couple the adjustment slide to the lever arm.

6. The furniture member adjustment system mechanism of claim 5, further including an upper housing cover connected to the upper housing structure, the upper housing cover including a slide tracking slot slidably guiding the upper end of the lever arm and providing clearance above the upper housing cover for motion of the adjustment slide above the upper housing cover.

7. A furniture member adjustment system mechanism, comprising:

a mechanism disposed within both an upper housing structure and a lower housing structure connected to the upper housing structure, the mechanism including:

a lever arm having an upper end extending above the upper housing structure, a body extending into both the upper and lower housing structures, and a lower end;

a cable connection bracket connected to the lower end of the lever arm, the cable connection bracket having a cable connection slot;

a fastener rotatably connecting the cable connection bracket and the lower end of the lever arm to the lower housing structure defining a common axis of rotation for the lever arm; and a tension control spring positioned between a nut connected to the fastener and one of a first or second side frame of the lower housing structure, wherein a biasing force of the tension control spring operates to frictionally restrict rotation of the lever arm to permit the lever arm to be retained in any of a plurality of rotated positions.

8. A furniture member adjustment system mechanism, comprising:

an upper housing structure and a lower housing structure connected to the upper housing structure, the lower housing structure including first and second side frames; and a mechanism disposed within both the upper and lower housing structures, including:

first and second lever arms each having an upper end extending above the upper housing structure, a body extending into both the upper and lower housing structures, and a lower end positioned in the lower housing structure and rotatably connected to the first and second side frames;

a biasing member connection bracket connected to the first and second side frames of the lower housing structure; and first and second biasing members each connected to one of the first and second lever arms and the biasing member connection bracket, the first and second biasing members being individually extended when one of the first or second lever arms is rotated from an initial position in a lever forward direction, a biasing force created by extension of the first or second biasing member operating to bias the first or second lever arm toward the initial position.

9. The furniture member adjustment system mechanism of claim 8, further including a fastener rotatably connecting the lower ends of the first and second lever arms to the first and second side frames, the fastener defining a common axis of rotation for the first and second lever arms.

10. The furniture member adjustment system mechanism of claim 8, further including an upper housing cover connected to the upper housing structure, the upper housing cover including first and second slide tracking slots operating to slidably guide the upper end of the first and second lever arms.

11. The furniture member adjustment system mechanism of claim 8, further including a cable sheath connection bracket connected to the first and second side frames, the cable sheath connection bracket including first and second cable alignment bores each adapted to slidably align one of the first and second cables for engagement with one of the first and second cable connection slots.

12. The furniture member adjustment system mechanism of claim 8, further including first and second cable connection brackets each connected to the lower end of one of the first and second lever arms, the first and second cable connection brackets each having a cable connection slot.

13. The furniture member adjustment system mechanism of claim 12, further including first and second cables individually slidably disposed within first and second flexible cable sheaths, the first and second cables each engaged at a first end to the cable connection slot of one of the first and second cable connection brackets, the first and second cables each having a second end connected to and operating to move a furniture member component when either the first or second lever arm is rotated.

14. A furniture member adjustment system, comprising:

a mechanism disposed within both an upper housing structure and a lower housing structure connected to the upper housing structure;

first and second lever arms each having an upper end extending above the upper housing structure, a body extending into both the upper and lower housing structures, and a lower end positioned in the lower housing structure;

an adjustment slide connected to an upper end of each of the first and second lever arms to assist in manually rotating the first and second lever arms;

first and second cable connection brackets connected to the lower end of each of the first and second lever arms, each of the first and second cable connection brackets having a cable connection slot;

a fastener rotatably connecting both the first and second cable connection brackets and the lower ends of the first and second lever arms to the lower housing structure, the fastener defining a common axis of rotation for the first and second lever arms; and first and second cables individually slidably disposed within first and second flexible cable sheaths, the first and second cables each having a first end individually engaged to the cable connection slot of one of the first and second cable connection brackets and each having a second end connected to a furniture member component operating when axially displaced to move the furniture member component.

15. The furniture member adjustment system of claim 14, wherein the upper housing structure includes:

first and second side panels;

an upper housing cover fastened to the first and second side panels; and a U-shaped housing base having an arm receiving slot adapted to permit full rotation of both the first and second lever arms.

16. The furniture member adjustment system of claim 15, wherein the lower housing structure includes:

first and second side frames; and a plurality of tubular fastener spacers extending from the first and second side frames adapted to connect the first and second side frames to the U-shaped housing base of the upper housing structure.

17. The furniture member adjustment system of claim 15, wherein the first and second lever arms each include an arm offset portion adapted to receive a slide pin extending through an arcuate shaped slot of individual ones of the first and second side panels, the arm offset portion of the first lever arm positioned proximate to an inner face of the first side panel and the arm offset portion of the second lever arm positioned proximate to an inner face of the second side panel.

18. The furniture member adjustment system of claim 14, wherein the furniture member component is a headrest portion operable to rotate in a forward motion and a rearward motion, and to extend upwardly with respect to a back support portion of a furniture member.

19. The furniture member adjustment system of claim 18, further including a headrest extension system connected to the headrest portion having the second end of the second cable connected thereto, wherein rotation of the second lever arm in a lever forward direction operates to upwardly extend the headrest portion in a headrest extension direction.

20. The furniture member adjustment system of claim 18, wherein rotation of the first lever arm in a lever forward direction operates to rotate the headrest portion in a headrest forward rotation direction.

21. The furniture member adjustment system of claim 20, further including:

an actuation assembly connected to the second end of the first cable; and an actuation link connecting the actuation assembly to the headrest portion.

* * * * *